US008328444B2

(12) United States Patent
Rathbun et al.

(10) Patent No.: US 8,328,444 B2
(45) Date of Patent: Dec. 11, 2012

(54) APPARATUS AND METHOD FOR PRINTING ON IRREGULAR SURFACES

(75) Inventors: Darryl T. Rathbun, Stratford, CT (US); Larry F. Eisner, Farmington, CT (US); Ralph A. Rapillo, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 1926 days.

(21) Appl. No.: 11/319,321

(22) Filed: Dec. 28, 2005

(65) Prior Publication Data

US 2007/0147926 A1 Jun. 28, 2007

(51) Int. Cl.
*B41J 2/01* (2006.01)
*B25B 11/00* (2006.01)

(52) U.S. Cl. ..... 400/645; 400/648; 347/104; 248/363; 269/21

(58) Field of Classification Search ..... 400/648, 400/656; 271/90, 98, 104, 106, 276; 347/104; 248/363; 269/21; 198/689.1
See application file for complete search history.

(56) References Cited

U.S. PATENT DOCUMENTS

| | | | | |
|---|---|---|---|---|
| 6,758,560 | B2 * | 7/2004 | Haug | 347/102 |
| 6,786,664 | B2 * | 9/2004 | Claramunt et al. | 400/656 |
| 6,801,726 | B2 * | 10/2004 | Shimizu et al. | 399/44 |
| 2007/0146450 | A1 * | 6/2007 | Domoto et al. | 347/90 |

* cited by examiner

*Primary Examiner* — Ren Yan
*Assistant Examiner* — Marissa Ferguson Samreth
(74) *Attorney, Agent, or Firm* — Brian A. Collins; Charles R. Malandra, Jr.; Steven J. Shapiro

(57) ABSTRACT

An apparatus and method for presenting a substrate/print media having favorable surface conditions and optimum spatial orientation for printing purposes. The apparatus/method includes a mechanism for maintaining the substrate/print media in a substantially orthogonal spatial orientation relative to the direction of ink deposition, and a pressurization device for developing a pressure differential across a face surface of the substrate/print media such that positive pressure is applied to a surface opposing the face surface. The pressurization device provides a cushion of air to support the substrate/print media during ink deposition. The apparatus/method may further include a system for transporting the substrate/print media beneath or across a print head assembly for in-line printing on a mailpiece.

22 Claims, 3 Drawing Sheets

APPARATUS AND METHOD FOR PRINTING ON IRREGULAR SURFACES

TECHNICAL FIELD

The present invention relates generally to printing devices, and, more particularly, to a new and useful apparatus and method for printing on an irregular surface e.g., a non-planar content surface of a mailpiece, for improved efficacy and readability.

BACKGROUND OF THE INVENTION

Printers, scanners or other printing devices commonly employ a roller/print cylinder to support, or provide a rigid backing structure for the substrate material which carries the printed message/image. The backing structure generally serves to lay the substrate material locally orthogonal and/or at an appropriate distance from the print head/nozzle of the printer. Generally, irregularities in the print surface degrade the efficacy of the printed message/image, i.e., resulting in smearing, smudging, gaps or other undesirable print characteristics.

Envelopes for mailing purposes present unique challenges and anomalies which may be addressed before or after an envelope has been filled or fabricated. It will generally be appreciated that printing prior to envelope filling is most likely to yield a flat/planar surface for optimum printing conditions. That is, an envelope can be viewed as having a print surface comprising multiple layers (a stack having at least two layers when considering the top and bottom face sheets of the envelope) and is best suited for printing before internal contents add other layers or create surface irregularities/anomalies due to an internal staple, clip or binding element.

While certain information such as the mailing address may be pre-printed on an envelope prior to the insertion of mailpiece content material, other information such as the postage indicia should desirably be printed subsequent to mailpiece fabrication. That is, since postage indicia is oftentimes based upon the weight, size and/or thickness of a mailpiece, the postage indicia, which typically includes a combination of graphics and barcode elements, will be printed after the envelope has been filled, sealed and/or weighed. Consequently, the ability to print on an envelope, which may include inserts having staples, clips and/or other binding elements, is necessary, but nonetheless presents challenges in terms of the surface characteristics/conditions which yield optimum print quality.

A need therefore exists for a method and apparatus for printing on an irregular surface while maintaining print efficacy and readability.

SUMMARY OF THE INVENTION

An apparatus/method is provided for printing on the face surface of a substrate material including a print head for depositing ink on the face surface and a means for developing a pressure differential across the face surface. The pressure generating means causes a positive pressure to be developed along the underside of the substrate material, i.e., in a direction opposing the face surface. Specifically, the pressurization means provides a cushion of air to support the substrate/print media during ink deposition and may further include a system for transporting the substrate/print media beneath or across a print head for in-line printing on a mailpiece.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE DRAWINGS

The present invention is described in the context of an in-line printer assembly for printing text/graphics along a region or zone of a mailpiece as it is conveyed beneath or past a print head assembly. Examples of such regions/zones include those relating to or in-line with the postage indicia, recipient mailing address or sender return address. While the invention is described in the context of a mailpiece, it will be appreciated that the invention is useful for printing on any substrate material/media. Furthermore, the invention has particular application to print media having underlying structures/elements which may cause surface irregularities, i.e., when such structures/elements serve to support the media during ink deposition.

The print head assemblies may include inkjet, bubble-jet or any thermally-activated multi-nozzle array for depositing ink and may be controlled/positioned by any of a variety of processors and conventional printing/computer interface control systems. Inasmuch as such systems and control algorithms are well-known in the art, such elements also will not be described in detail herein. Moreover, similar to other known inkjet printers and print head assemblies, the inkjet printer and print head assembly may employ multiple print heads for delivering and depositing ink on the subject media. Suffice it to say that a variety of print heads may be employed including thermal inkjet heads such as one-half inch (½") and one-sixth inch (⅙") print area heads available from Hewlett-Packard Company under the model designations HP51645A and HP51626A, respectively. Inkjet print heads using other technologies may also be incorporated.

In the broadest sense of the invention, an apparatus and method is provided for presenting a substrate print media in an optimum spatial orientation for printing thereon, comprising: (i) a means for maintaining the substrate media in a substantially orthogonal spatial orientation relative to the direction of ink deposition, and (ii) a means for developing a pressure differential across a face surface of the media such that positive pressure is applied to a surface opposing the face surface thereby providing a cushion of air to support the substrate media during ink deposition.

Figure 1:
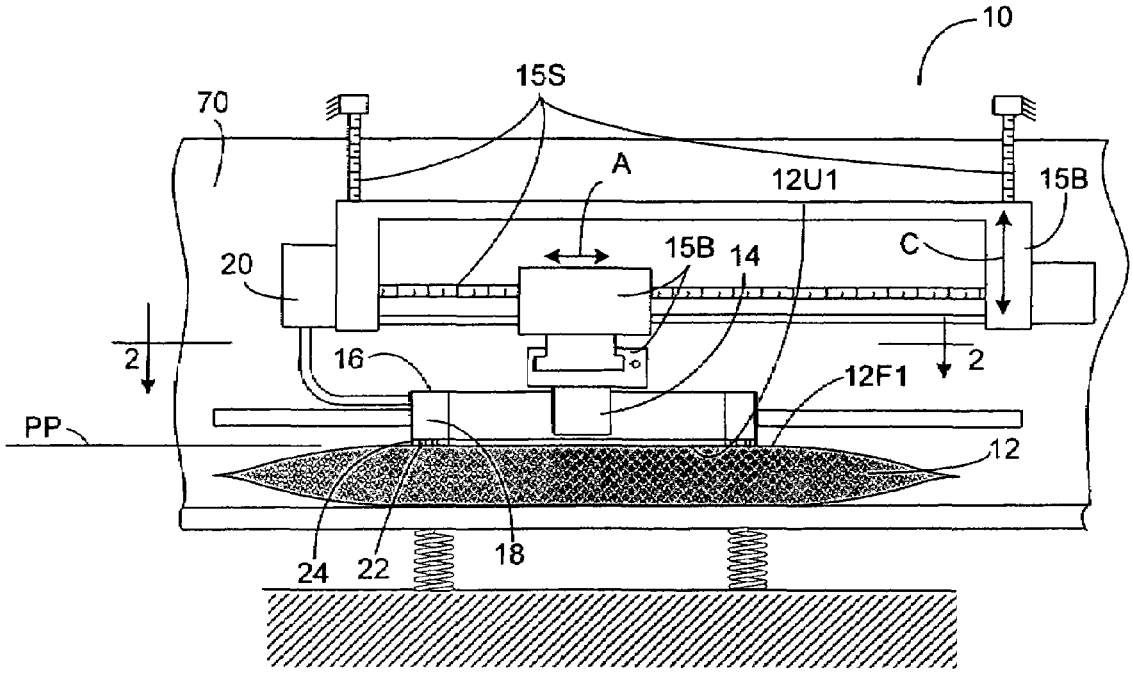
FIG. 1 depicts a side view of an in-line printing apparatus, the apparatus producing an optimum print surface for printing clear, legible text and graphics on the face surface of a substrate material.
Figure 2:
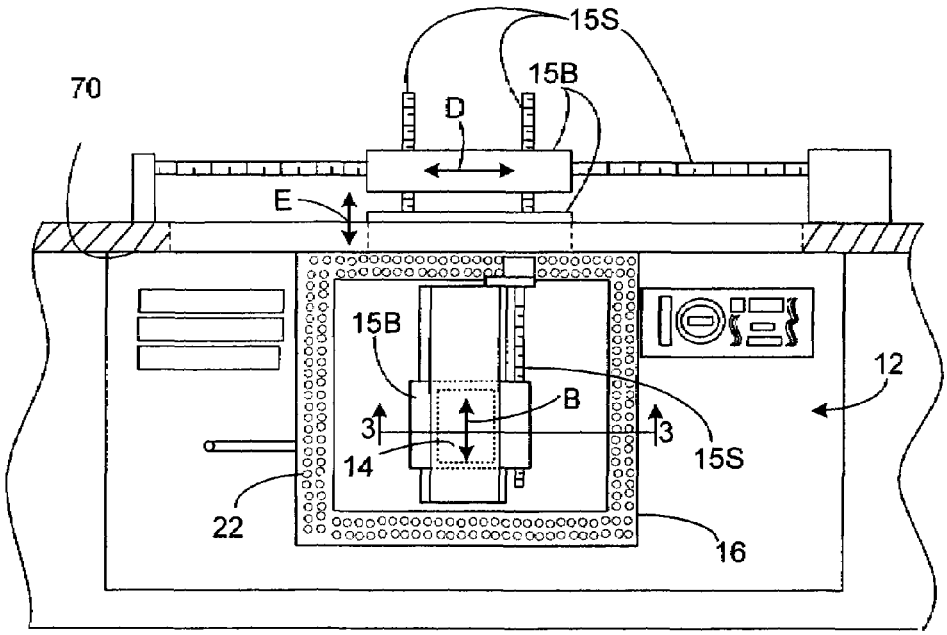
FIG. 2 depicts a cross-sectional view taken substantially along line 2-2 of FIG. 1 illustrating a plenum circumscribing the print head, which plenum develops a pressure differential across the face surface of the substrate material.

Referring to FIGS. 1 and 2, an apparatus 10 is depicted for supporting and spatially positioning a fabricated mailpiece 12 beneath/past a print head 14 (shown schematically as a simple rectangular block). For the purposes of illustration, it is assumed that the mailpiece 12 is filled with content material, sealed and ready for sorting or subsequent processing, e.g., delivery. The print head 14 may be positioned and manipulated about various axes A, B and C to enable printing in a two dimensional plane, i.e., in a plane PP corresponding to the face surface 12F1 of the mailpiece 12. Likewise, the plenum 16 may be positioned and manipulated about various axes D and E to enable relocation of the plenum relative to the substrate material. The figures schematically show a combination of linear screws 15S which rotate to drive bearing blocks 15B linearly along the axes A, B, C, D and E. It will be appreciated, however, that a variety of linear, telescoping or rotary links/elements/tracks may be employed to effect the motion of the print head 14 relative to the underlying mailpiece 12.

Figure 3:
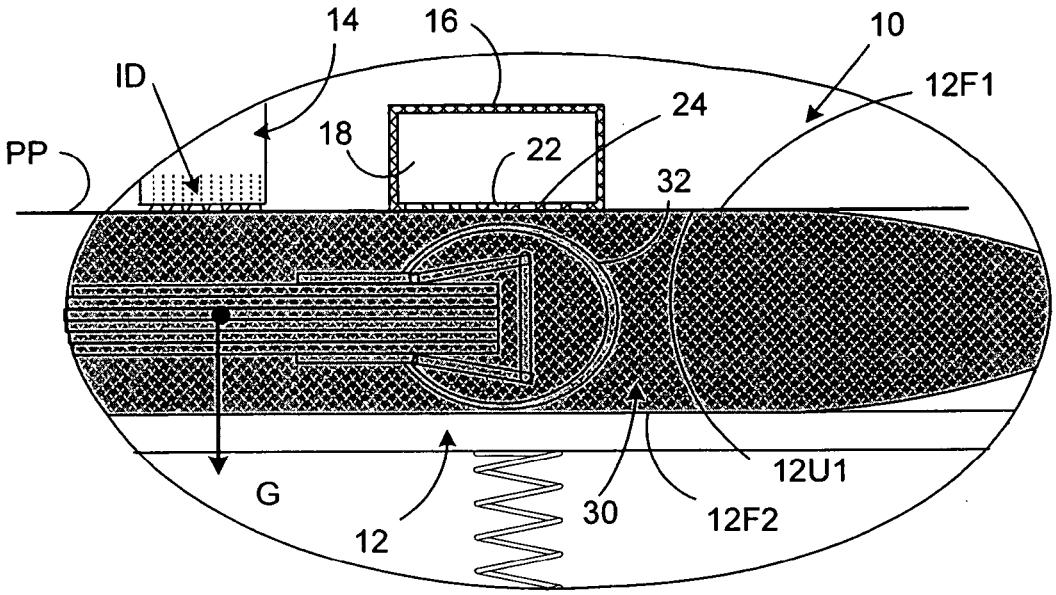
FIG. 3 depicts an enlarged partial cross-sectional view taken substantially along line 3-3 of FIG. 2 illustrating features of the apparatus which lift the face surface of the substrate material away from underlying structures/elements to present a substantially planar surface for printing.

In FIG. 3, the apparatus 10 is disposed in combination with the print head 14 and includes a plenum 16 defining a channel 18 in fluid communication with a vacuum source 20. The plenum 16 further includes a plurality of apertures or orifices 22 extending through a wall 24 of the plenum 16 and in fluid communication with the face surface 12F1 of the mailpiece 12. While the described embodiment illustrates a plenum 16 circumscribing the print head 14, it should be noted that the plenum 16 may be segmented/bifurcated, e.g., having dual segments, and disposed on opposing sides of the print head 14. Such alternate configurations will be discussed in greater detail below.

The vacuum source 20 (see FIG. 1) is operative to develop a pressure differential across the face surface 12F1 of the mailpiece 12. Inasmuch as the plenum 16 circumscribes the print head 14, the plenum 16 develops a bridging effect in the area enveloped by the plenum 16, and, by virtue of its circumscribed shape, achieves two independent yet complimentary functions. Firstly, the circumscribed plenum 16 causes the face surface 12F1 of the mailpiece to span its diameter to present the face surface 12F1 of the mailpiece 12 in a substantially planar orientation relative to the print head 14. Secondly, the face surface 12F1 is spatially positioned to be orthogonal relative to the direction ID of ink deposition. As such, the face surface 12F1 is supported and stiffened, i.e., made rigid, by the suction developed across the face surface 12F1 of the mailpiece 12. Accordingly, ink may be deposited by the print head 14 on a substantially planar surface with minimal deformation or deflection of the printing surface, i.e., the face surface 12F1.

While the apparatus 10, i.e., the plenum 16 and vacuum source 20, function to accurately position and support the face surface 12F1 of the mailpiece 12, the apparatus 10 also functions to lift the face surface 12F1 away from any internal structure or mailpiece content 30 which may be contained within the mailpiece 12. That is, the face surface 12F1 is drawn away from internal mailpiece contents 30 which, under the force of gravity, fall away from the underside 12U1 of the face surface 12F1. In the illustrated embodiment, the mailpiece content 30 includes a semi-circular binder 32 which has separated from the underside surface 12U1 under the force of gravity acting in the direction of arrow G. The apparatus 10, therefore, eliminates any surface irregularities, e.g., the semi-circular binder 32, from disrupting the plane of the print surface, i.e., the face surface 12F1. Consequently, the apparatus 10 improves efficacy and readability of messages/images printed by the print head 14.

Figure 4:
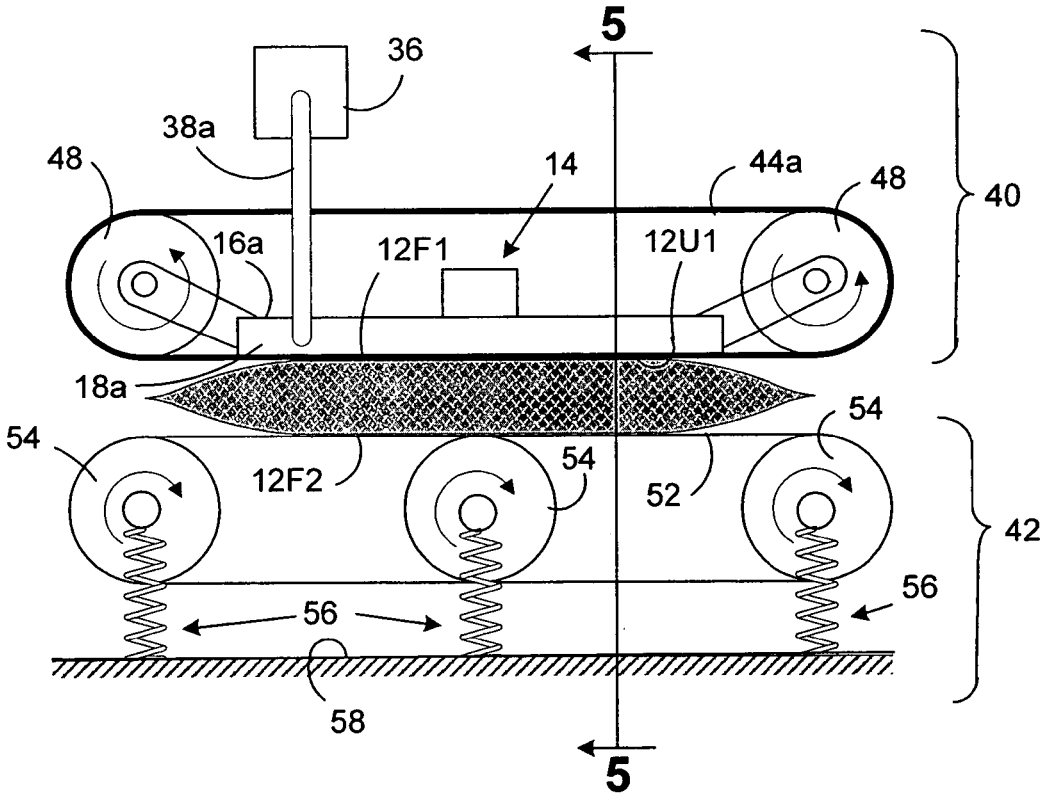
FIG. 4 depicts an alternate embodiment of the invention including upper and lower conveyors for supporting/moving the mailpiece past an in-line print head and a linear plenum system for developing a pressure differential along the face surface of the substrate material.
Figure 5:
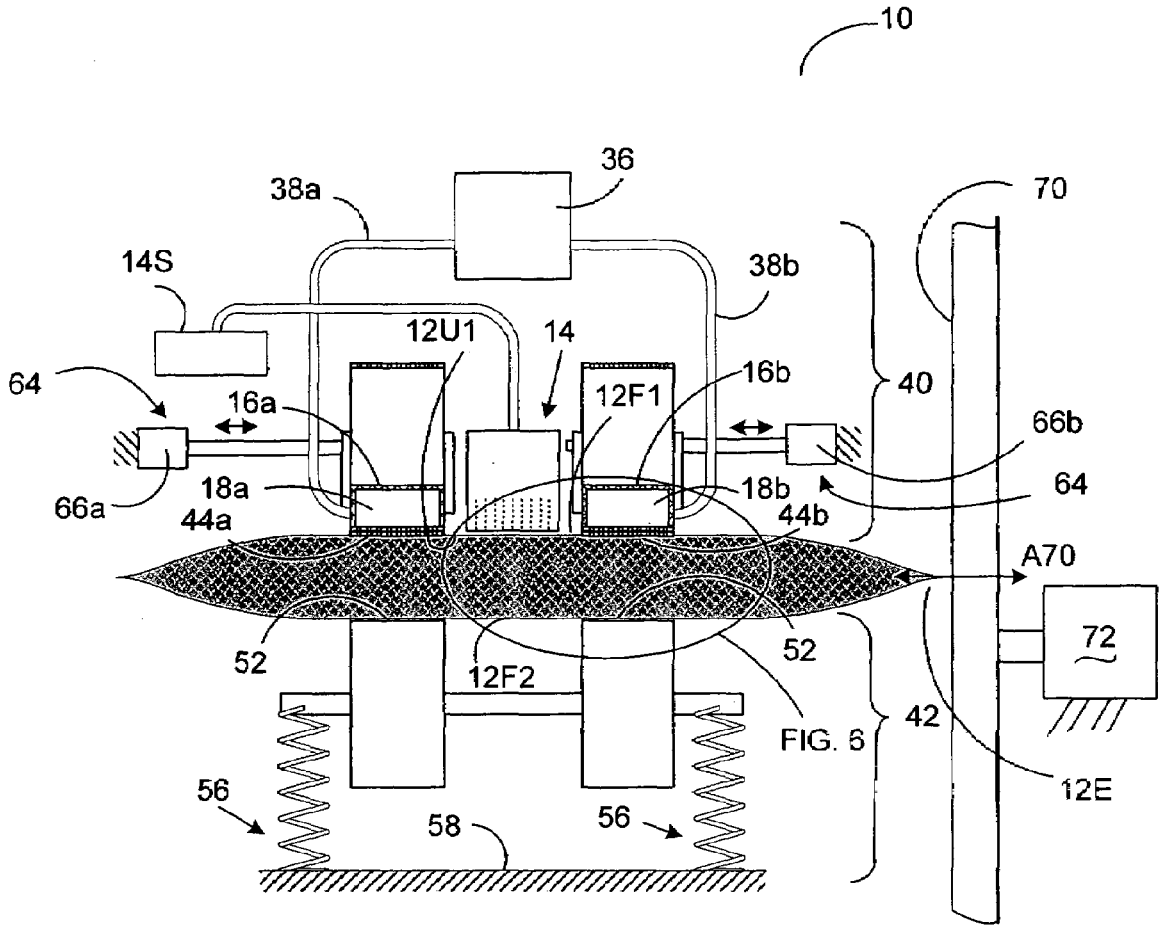
FIG. 5 depicts a cross-sectional view taken substantially along line 5-5 of FIG. 4 illustrating a pair of linear plenums disposed to either side of the in-line print head.
Figure 6:
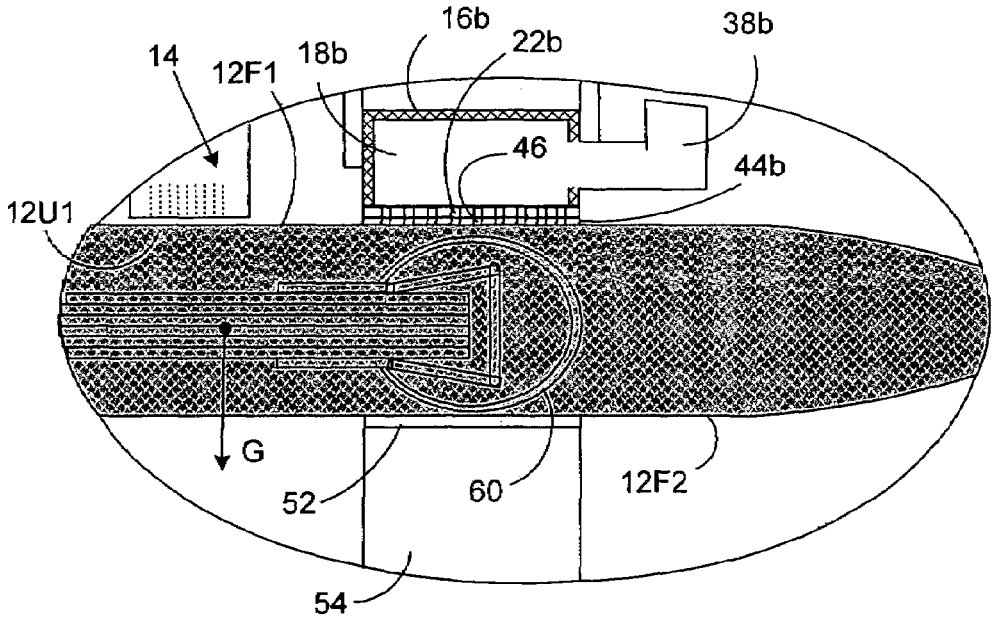
FIG. 6 depicts an enlarged view of one of the linear plenums shown in FIG. 5 illustrating a perforated conveyor belt for conveying the substrate material past the in-line print head.

In another embodiment of the invention shown in FIGS. 4, 5 and 6, the plenum is bifurcated to form pair of linear plenum segments 16*a*, 16*b* disposed to either side of the print head 14. The plenums segments 16*a*, 16*b* include chambers 18*a*, 18*b*, which are in fluid communication with a common vacuum source 36 (FIGS. 4 & 5), having conduits 38*a*, 38*b* coupled to each of the chambers 18*a*, 18*b*. Furthermore, the apparatus 10 includes upper and lower conveyors 40, 42 which function to transport and support the mailpiece 12 as it moves a past the print head 14, (a system for printing mailpieces commonly known as an in-line print head/printer). More specifically, the upper conveyor 40 includes perforated belts 44*a*, 44*b* disposed between each of the plenum segments 16*a*, 16*b* and the underlying mailpiece 12. The perforations 46 (See FIG. 6) in the belts 44*a*, 44*b* provide a fluid path from the face surface 12F1 of the mailpiece 12, to the respective chambers 18*a*, 18*b* via apertures 22*a*, 22*b* formed in each of the segments 16*a*, 16*b*. Moreover the perforations 46 are adapted to provide a substantially constant fluid flow across the belts 44*a*, 44*b*. Such constant fluid flow may be effected by employing rows of perforations each having a substantially rectangular shape (not shown) and, further, being spaced in a staggered configuration. That is, adjacent rows of perforations 46 in the belts 44*a*, 44*b* may be staggered or phased relative to the apertures 22*a*, 22*b* formed in the plenum walls to avoid an alternating alignment/misalignment of the perforations 44*a*, 44*b* with the apertures 22*a*, 22*b* of the plenum segments 16*a*, 16*b*. As a result, the fluid flow will be shared across the perforations 46 rather than opening/closing as a function of a full/partial alignment of the perforations 44*a*, 44*b*, and apertures 22*a*, 22*b*.

The belts 44*a*, 44*b* are driven over a system of drive wheels or pulleys 48 to convey the belts 44*a*, 44*b* linearly past the in-line print head 14 and to each side thereof. The lower conveyor 42 is more conventional inasmuch as the conveyor belts or belt 52 need not include perforations, but need only support and assist the movement of the mailpiece 12. More specifically, the lower conveyor 42 includes a system of wheels or pulleys 54 which support mailpiece at a height that will allow contents to separate from the surface 12U1. Furthermore, the lower conveyor 42 may lightly support the mailpiece 12 by a suspension system 56. By "lightly support" is meant that the lower conveyor 42 supports a fraction of the total mailpiece weight. In the illustrated embodiment, the suspension system 56 is shown schematically as a simple coil spring arrangement disposed between each of the wheels 54 and a stationary ground 58, however, any arrangement which supports less than the total weight of the mailpiece, i.e., while being conveyed along the feed path, may be employed.

Similar to the previously described embodiment, the plenum segments 16*a*, 16*b* develop a bridging effect in the area therebetween. More specifically, the plenum segments 16*a*, 16*b* cause the face surface 12F1 to span the distance therebetween and maintain a substantially planar orientation relative to the print head 14. As such, the face surface 12F1 is supported and stiffened, i.e., made rigid, by the suction developed across the face surface 12F1 of the mailpiece 12. Accordingly, ink may be deposited by the print head 14 on a substantially planar surface with minimal deformation or deflection of the printing surface, i.e., the face surface 12F1.

Furthermore, in a manner similar to the annular plenum, the linear plenum segments 16*a*, 16*b* function to lift the face surface 12F1 away from internal structure or mailpiece content material 60 which may be contained within the mailpiece 12. That is, the face surface 12F1 is drawn away from internal mailpiece contents which, under the force of gravity, fall away from the underside 12U1 of the face surface 12F1. In the illustrated embodiment, the mailpiece content 60 has fallen away from the underside surface 12U1 under the force of gravity acting in the direction of arrow G. The apparatus 10, therefore, eliminates any surface irregularities disrupting the plane of the print surface, i.e., the face surface 12F1.

In an alternate embodiment of the invention, a mechanism 64 may be employed to increase the separation distance between the plenum segments 16*a*, 16*b* for the purpose of applying a tensile load across the face surface 12F1 of the mailpiece 12 during ink deposition. For example, a pair of linear actuators 66*a*, 66*b* may be coupled to each of the plenum segments 16*a*, 16*b*, to separate the segments, including the conveyor belts 44*a*, 44*b*. Consequently, the applied tensile load alleviates or removes any surface irregularities along the face surface 12F1.

Furthermore, while the plenum segments 16*a*, 16*b* may move apart, the segments 16*a*, 16*b* may also move together, i.e., in concert, to change the relative position of the print head 14, i.e., the position of the print head relative to the face surface 12F1 of the mailpiece 12. Alternatively, a registration wall 70 may be used to locate the mailpiece 12 relative to the print head 14. More specifically, the registration wall 70 may be positioned by means of a linear actuator 72 connecting to and located opposite an abutting edge 12E of the mailpiece 12. As the registration wall 70 translates along axis A70, the mailpiece 12 may be shifted in the same direction to change its print position relative to the print head 14.

Without the further recitation of specific structure to handle the mailpiece, the method is practiced by the steps of (i) supporting the print head relative to the mailpiece such that the face surface thereof is substantially orthogonal to the direction of ink deposition by the print head, (ii) developing a pressure differential across a face surface of the mailpiece such that a positive pressure is applied to a surface opposing the face surface to support the face surface of the mailpiece, and (iii) printing on the face surface of the mailpiece. The various mechanisms for performing these steps may be those previously described or other devices having similar functional characteristics. Furthermore, the mailpiece may be conveyed by an upper and/or lower conveyor in a manner similar to that previously described or via a variety of similar devices.

In summary, an apparatus and method is provided for printing on a substrate material or mailpiece while maintaining a substantially planar orientation during ink deposition. The device may include an annular or linear plenum to develop a pressure differential across the face surface of the substrate material or mailpiece. Alternatively, other mechanisms can be envisioned for developing a pressure differential. For example, a positive pressure may be developed internally of the mailpiece to prevent the content material from creating surface irregularities along the exposed face surface. Similarly, other devices may be employed to draw the face surface away from underlying material so as to avoid disrupting the contour of the print surface. Accordingly, a planar surface contour may be maintained to ensure optimum print quality/readability.

It is to be understood that the present invention is not to be considered as limited to the specific embodiments described above and shown in the accompanying drawings. The illustrations merely show the best mode presently contemplated for carrying out the invention, and which is susceptible to such changes as may be obvious to one skilled in the art. The invention is intended to cover all such variations, modifications and equivalents thereof as may be deemed to be within the scope of the claims appended hereto.

What is claimed is:

1. An apparatus for printing on a face surface of a substrate material, comprising: a print head spatially positioned relative to the substrate material for depositing ink on the face surface, and a means for developing a pressure differential across a face surface of the substrate material such that pressure is applied to an underside surface of the substrate material opposite the face surface and for supporting the substrate material as the print head deposits ink on the face surface, the means for developing a pressure differential further including:

a plenum defining a chamber, the plenum enveloping the print head on at least two sides thereof and having a plurality of apertures through a wall of the plenum, the apertures disposed adjacent the face surface of the substrate material, and a vacuum source disposed in fluid communication with the chamber of the plenum, the vacuum source is operative to develop the pressure differential across the face surface of the substrate material during ink deposition.

2. The apparatus according to claim 1 wherein the plenum circumscribes the print head.

3. The apparatus according to claim 1 wherein the plenum forms linear plenum segments disposed on each side of the print head.

4. The apparatus according to claim 1 further comprising an upper conveyor having a conveyor belt disposed between the plenum and the face surface of the substrate material.

5. The apparatus according to claim 4 wherein the conveyor belt includes a plurality of perforations therein to facilitate the development of a pressure differential across the face surface of the substrate material.

6. The apparatus according to claim 5 wherein the perforations of the belt and apertures of the plenum effect a substantially constant fluid flow as the belt moves across the plenum.

7. The apparatus according to claim 4 further comprising an lower conveyor having a belt contiguous with a lower surface of the substrate material for supporting the same at a predetermined distance relative to the print head.

8. The apparatus according to claim 4 further comprising a registration wall disposed adjacent an edge of the mailpiece and a means for positioning the registration wall to change a position of the print head relative to the face surface of the mailpiece.

9. The apparatus according to claim 4 further comprising an lower conveyor having a belt contiguous with a lower surface of the substrate material for lightly supporting weight of the substrate material.

10. The apparatus according to claim 1 wherein the substrate material defines a mailpiece envelope having first and second face surfaces and content material therebetween, and wherein the plenum develops the pressure differential across one of the face surfaces to separate the content material from the underside thereof thereby obviating surface irregularities during ink deposition.

11. The apparatus according to claim 1 wherein the plenum forms linear plenum segments disposed on each side of the print head and further comprising a means for separating the plenum segments to apply a tensile load across the face surface during ink deposition.

12. An apparatus for printing on a mailpiece having first and second face surfaces and content material therebetween and a print head for depositing ink on a face surface of the mailpiece, comprising:

a device for spatially positioning the print head relative to the substrate material such that the substrate material is substantially orthogonal to a direction of ink deposition by the print head, and a plenum defining a chamber, the plenum enveloping the print head on at least two sides thereof and having a plurality of apertures through a wall of the plenum, the apertures disposed adjacent the face surface of the substrate material, and a vacuum source disposed in fluid communication with the chamber of the plenum, whereby the vacuum source is operative to develop the pressure differential across one of the face surfaces to separate the content material from the underside of the face surface thereby obviating surface irregularities during ink deposition.

13. The apparatus according to claim 12 wherein the plenum circumscribes the print head.

14. The apparatus according to claim 12 wherein the plenum is bifurcated to form linear plenum segments disposed on each side of the print head.

15. The apparatus according to claim 12 further comprising an upper conveyor having a conveyor belt disposed between the plenum and the face surface of the substrate material, the conveyor belt moving the substrate material past the print head during ink deposition.

16. The apparatus according to claim 15 wherein the conveyor belt includes a plurality of perforations therein to facilitate a development of a pressure differential across the face surface of the substrate material.

17. The apparatus according to claim 15 further comprising an lower conveyor having a belt contiguous with a lower surface of the substrate material for supporting a portion of its weight during ink deposition.

18. The apparatus according to claim 12 wherein the plenum forms linear plenum segments disposed on each side of the print head and further comprising a means for separating the plenum segments to apply a tensile load across the face surface during ink deposition.

19. A method for printing on a face surface of a mailpiece by using a print head for depositing ink, the method comprising the steps of:

supporting the print head relative to the mailpiece such that the face surface thereof is substantially orthogonal to a direction of ink deposition by the print head, developing a pressure differential across a face surface of a substrate material such that a pressure is applied to an underside surface opposite the face surface to support the face surface of the mailpiece during print operations, the pressure differential produced by a plenum defining a chamber, the plenum enveloping the print head on at least two sides thereof and having a plurality of apertures through a wall of the plenum, the apertures disposed adjacent the face surface of the substrate material, and providing a vacuum source disposed in fluid communication with the chamber of the plenum, the vacuum source being operative to develop the pressure differential across the face surface to separate content material from the underside thereof to obviate surface irregularities during ink deposition, and printing on the face surface of the mailpiece.

20. The method according to claim 19 further including the step of providing an upper conveyor having a conveyor belt disposed between the plenum and the face surface of the substrate material, the conveyor belt moving the substrate material past the print head during ink deposition.

21. The method according to claim 20 wherein the conveyor belt includes a plurality of perforations therein to facilitate a development of a pressure differential across the face surface of the mailpiece.

22. The method according to claim 20 further including the step of providing a lower conveyor having a belt contiguous with a lower surface of the substrate material for supporting a portion of its weight during ink deposition.

* * * * *